United States Patent [19]

Maese

[11] Patent Number: 4,794,225

[45] Date of Patent: Dec. 27, 1988

[54] TUBE AXIAL HANDHELD BLOW DRYER FOR HAIR

[76] Inventor: Hector L. Maese, 1025 S. Solano, Las Cruces, N. Mex. 88001

[21] Appl. No.: 106,399

[22] Filed: Oct. 9, 1987

[51] Int. Cl.[4] ..... F24H 7/00; H05B 1/00; H05B 3/02

[52] U.S. Cl. ..... 219/370; 219/374; 34/97

[58] Field of Search ..... 219/369, 370, 372, 373, 219/374, 375, 222; 34/97

[56] References Cited

U.S. PATENT DOCUMENTS

| | | | |
|---|---|---|---|
| 4,309,595 | 1/1982 | Long et al. | 219/370 |
| 4,538,362 | 9/1985 | Andis | 219/370 X |
| 4,596,921 | 6/1986 | Hersh et al. | 219/370 |
| 4,629,864 | 12/1986 | Wilson | 219/374 |

FOREIGN PATENT DOCUMENTS

| | | |
|---|---|---|
| 7900374 | 6/1979 | Int'l Pat. Institute . |
| 8000783 | 5/1980 | Int'l Pat. Institute . |
| 2012362 | 7/1979 | United Kingdom . |
| 2044612 | 10/1980 | United Kingdom . |
| 2093526 | 9/1982 | United Kingdom . |
| 2170705 | 8/1986 | United Kingdom . |
| 2174900 | 11/1986 | United Kingdom . |

*Primary Examiner*—E. A. Goldberg
*Assistant Examiner*—M. M. Lateef
*Attorney, Agent, or Firm*—Cushman, Darby & Cushman

[57] ABSTRACT

A handheld blow dryer for hair is provided with a low static pressure tube axial fan having at least five blades and having a diameter which is approximately 98 percent of the ID of the air flow housing. The fan hub diameter approximately coincides with the motor casing diameter and the heating element is arranged in a torus or helix downstream of the fan. A typical housing outlet diameter of 2.875 inches provides a coverage area of about 6.5 square inches.

7 Claims, 6 Drawing Sheets

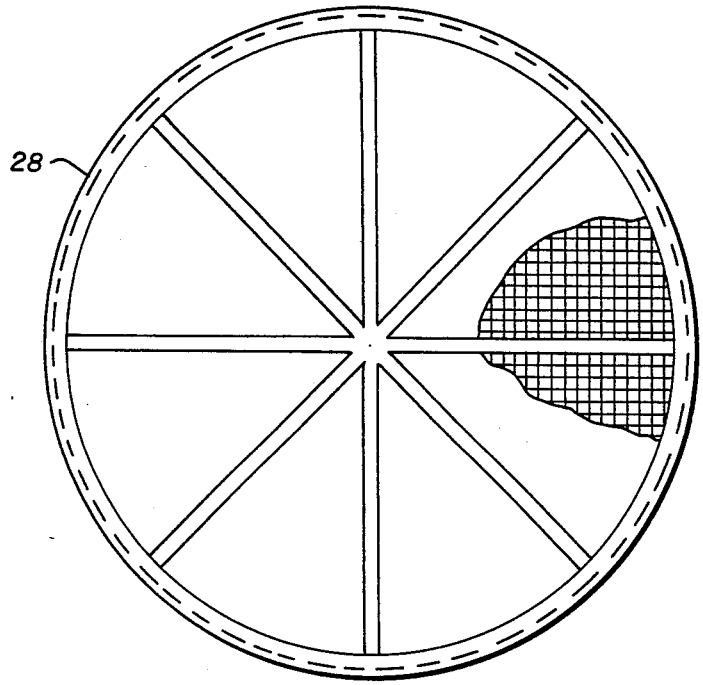
Fig. 3
Fig. 4
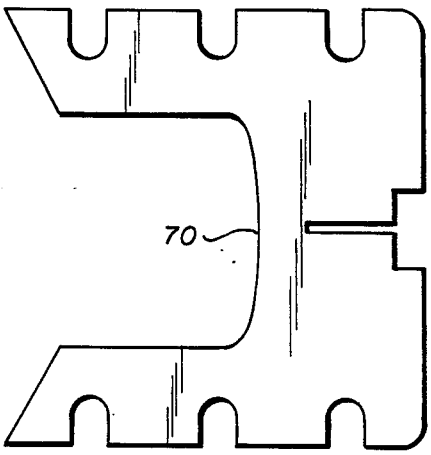
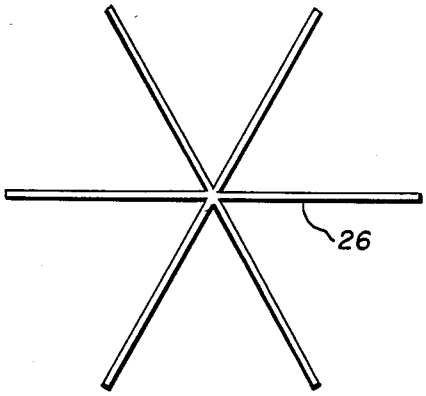
Fig. 5

TUBE AXIAL HANDHELD BLOW DRYER FOR HAIR

BACKGROUND OF THE INVENTION

With a few exceptions, the more than 75 models of handheld blow dryers that are marketed within the United States today fall into one of two basic categories: the turbo dryer, which is an application of vaneaxial fan, and the professional dryer, which is an application of a centrifugal fan. Of the exceptions, several provide a coverage area of more than 3.5 square inches, and will be discussed separately hereinbelow.

The typical conventional turbo blow dryer is lighter in weight than the typical conventional professional blow dryer, and ranges in weight from 0.50 to 0.75 pound.

The turbo dryer fan design is axial which means the air enters and exits the dryer by traveling along a single axis. This fan includes an impeller usually having four or more blades and and a diameter which is usually less than 1.88 inches. These fans also have, in general, fixed vanes for the impeller to help laminarize the outlet air stream, hence the term vaneaxial fan. The air stream developed by the rotation of the impeller moves longitudinally along the impeller axis of rotation. The cylindrical housing that confines and directs the fan air stream generally has an inside diameter of no more than 1.94 inches. The fractional HP DC motor that drives the impeller is approximately one inch in diameter and is rated upwards of 15,000 RPM.

The electric element used to heat the air stream is nominally rated at 1200 watts with models offered rated at 200 watts to either side of this value. The heating element is functionally supported by wrapping it around the longitudinal axis of a mica frame. The mica frame is made of two pieces that are orthogonally or obliquely fitted together which, when inserted into the heating element duct, forms four quadrants that the air stream is channeled through. The length of the heating element duct is most often a cylindrical match for the fan design, However, some dryers on the market have an elliptical barrel. Regardless of their geometric shape, their heating duct transverse cross-sectional areas range from 1.9 to 2.8 square inches.

In addition to the foregoing features, the typical turbo blow dryer has a pistol style handle with control switches for various heats and air flow rates; an electric power cord nominally 6 feet in length, and possibly a concentrator attachment which may be manually affixed to the outlet port to provide further air stream control for those coiffed styles.

The typical conventional professional dryer ranges in weight from 0.75 to 1.25 pounds and has either a paddle wheel impeller or the centrifugal blower wheel (squirrel cage) impeller.

Both impeller designs draw air in the side of the pistol shaped housing. This air enters at the center of the impeller along its axis of rotation. The rotation of the impeller exerts a centrifugal force on this incoming air causing an air stream to be thrown off radially. The housing confines this radially driven air stream and directs it into the heating element duct. Which is to say, the fan pulls in air from the side of the dryer and changes the air stream direction 90° in order to channel the air into the heating element duct. Either a DC motor, much like that used on the typical turbo dryer motor, or an universal motor is used to drive either type of impeller.

The diameter of the blower wheel impeller starts as low as 2.5 inches and may go up to 6 or more inches. Unfortunately, professional dryers using these larger blower wheels exhibit a moment through the handle. This force is tiring to the user in that it resists any movements by the user that are not exactly in line with the impeller axis of rotation. This moment is a consequence of the mass that rotates about the perimeter of the blower wheel.

Most of the professional dryers, however, use a paddle wheel impeller rather than a blower wheel. The paddle wheel diameters start around 2.5 inches and go up to 5 or more inches. The prevailing trade-off made here is that while the paddle wheel is not as efficient as the blower wheel (and hence is noisier for equivalent CFM), it does not exhibit the moment through the handle that the blower wheel does. In addition, it should be pointed out that the paddle wheel is less costly than the blower wheel.

The electric element used to heat the air stream is nominally rated at 1400 watts with models offered 200 watts above this value and 400 watts below. The heating element duct is generally identical to that of the turbo dryer design, except that not only are the barrels elliptical and circular but they are also rectangular and even trapezoidal. The heating duct cross-sectional areas range from 2 to 3.5 square inches. The additional features that round out the turbo dryer design also finish the design of the typical professional dryer.

Of the conventional dryers which have a relatively large outlet diameter, one has an outlet diameter of approximately 6.125 inches yielding nearly 29.5 squre inches of coverage. This much coverage does not yield effective air stream control or directivity of most hair styles; accordingly, this blow dryer design is aimed at the small-tight-curl hair styles. Correspondingly, its air flow velocity is a slow 170 feet/minute. This air flow velocity does not penetrate to the scalp for most towel dried hair styles and is therefore ineffective from this point of view. The same arguments hold for the Sunbeam model even though its coverage area is slightly scaled. Other models with greater than 3.5 square inches of coverage area tend to be offshoots of the turbo or professional models and they are ineffective for the same reasons the turbo or professional models are.

There are several interrelated disadvantages to the handheld blow dryers of the prior art. The units offered are universally noisy, even to the extent that one winces and dodges when using one. The noise level of the blow dryers is about equivalent to the noise level of vacuum cleaners. These units effectively cover only a small area, approximately the area of the circle created by one's thumb and first finger. Nearly all the conventional blow dryers cause a burning sensation if not kept in constant motion during use. And finally, the air velocity is characteristically so high that it radically displaces the hair during the drying process; this, along with the intense heat, causes the hair to develop small bristly tufts and a ruffled look that is successfuly corrected only with a curling iron.

The Underwriters Laboratory Standard for Electric Personal Grooming Appliances, UL859, establishes that the maximum temperature rise of the outlet air shall not exceed 180° F. Historically, the prior art has elected to market blow dryers with incrementally higher wattages escalating to the present nominal 1200–1400 range. In order to accommodate these high wattages and meet the UL859 temperature standard, the industry, has been required to increase the air flow rate. This has been done without corresponding alterations to the fan design dimensions or the heating element duct design dimensions. The result of this approach is that the static pressure, the energy loss within the dryer itself, increases quadradically as a function of the air flow rate. This is a direct consequence of the fan laws of physics. As a further result of the fan laws and the fact that the cross-sectional area is not increased, the air flow velocity, i.e. velocity pressure, also increases and is a direct function of the increased flow rate.

These combined deficiencies in the prior art constructional designs place products in the marketplace which are marginally acceptable.

SUMMARY OF THE INVENTION

A handheld blow dryer for hair is provided with a low static pressure tube axial fan having at least five blades and having a diameter which is approximately 98 percent of the ID of the air flow housing. The fan hub diameter approximately coincides with the motor casing diameter and the heating element is arranged in a torus or helix downstream of the fan. A typical housing outlet diameter of 2.875 inches provides a coverage area of about 6.5 square inches. The dryer is approximately one-quarter as noisy as most prior art dryers, yet provides effective penetrating air delivery without a need for constantly moving the dryer over to prevent overheating an area of the person's head.

The principles of the invention will be further discussed with reference to the drawings wherein a preferred embodiments is shown. The specifics illustrated in the drawings are intended to exemplify, rather than limit, aspects of the invention as defined in the claims.

BRIEF DESCRIPTION OF THE DRAWINGS

In the Drawings

FIG. 3 is a front elevational view of the rear screen/-rear grille assembly thereof;

FIG. 4 is a side elevational view of one of the heater support plates;

FIG. 5 is a front elevational view of the three heater support plates assembled to form a spider;

DETAILED DESCRIPTION

Figure 1:
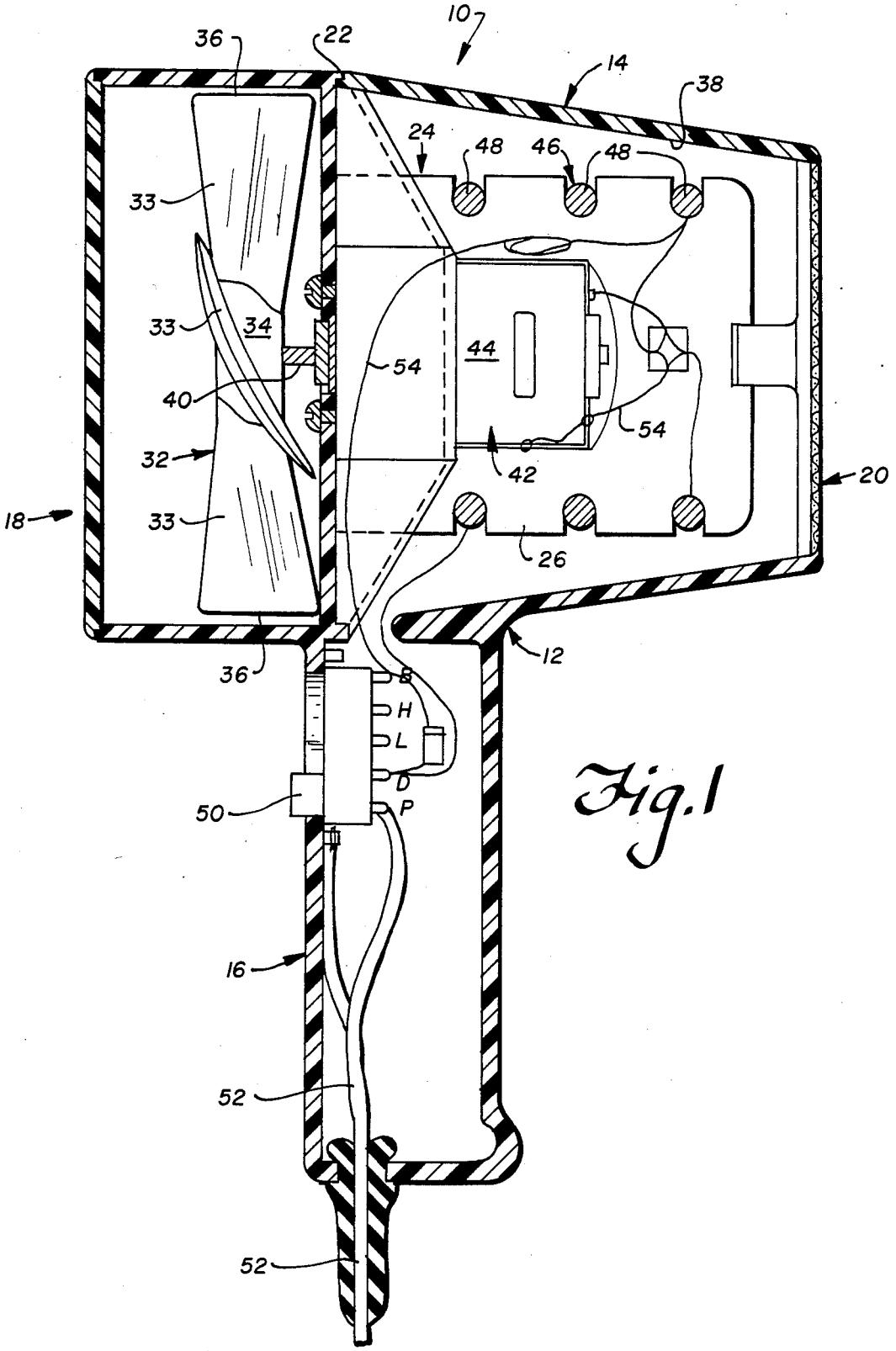
FIG. 1 is a schematic longitudinal cross-sectional view of a tube axial handheld dryer embodying principles of the present invention.
Figure 2:
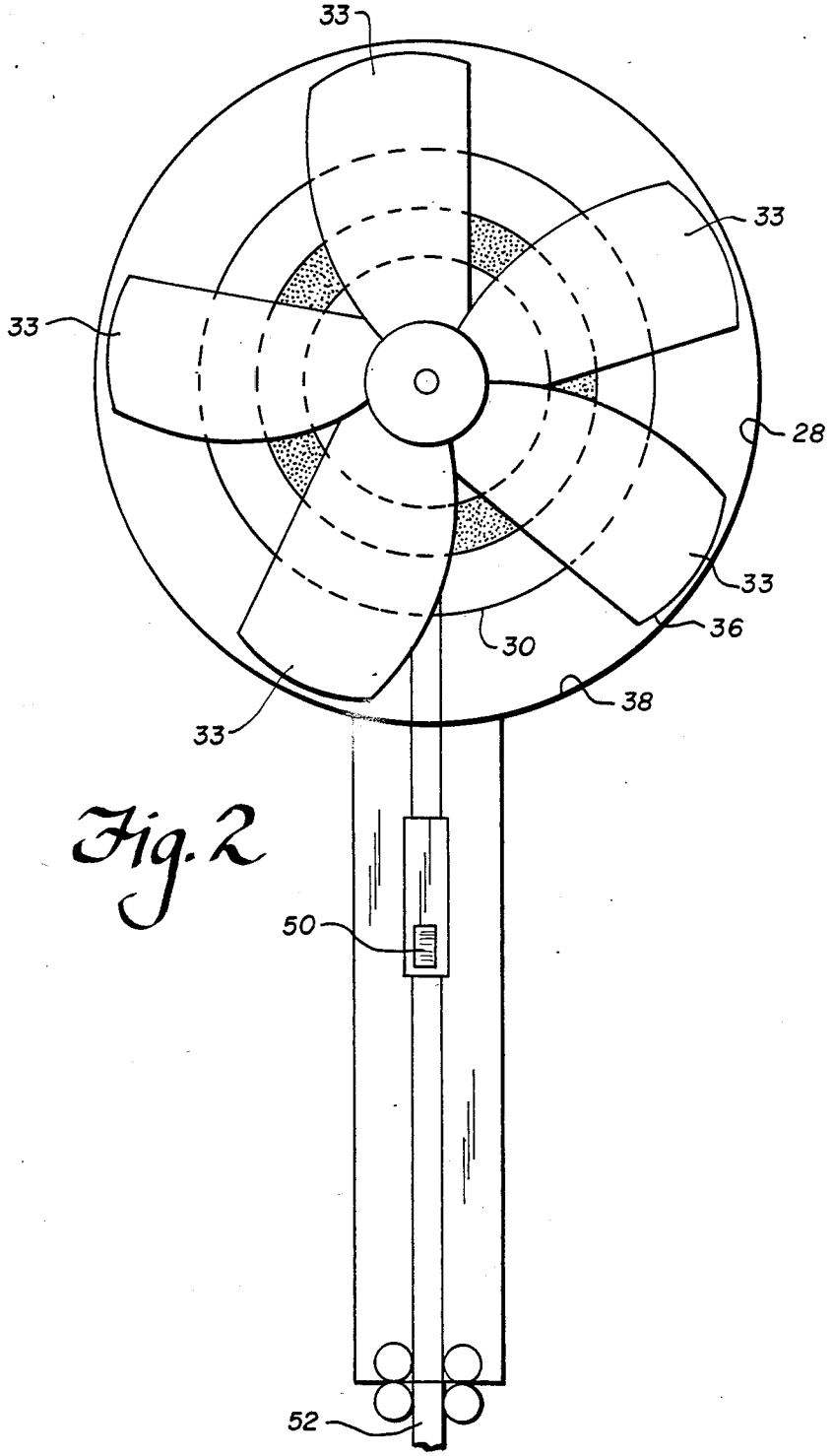
FIG. 2 is a schematic rear elevational view thereof, with the rear screen rear grille removed.
Figure 6:
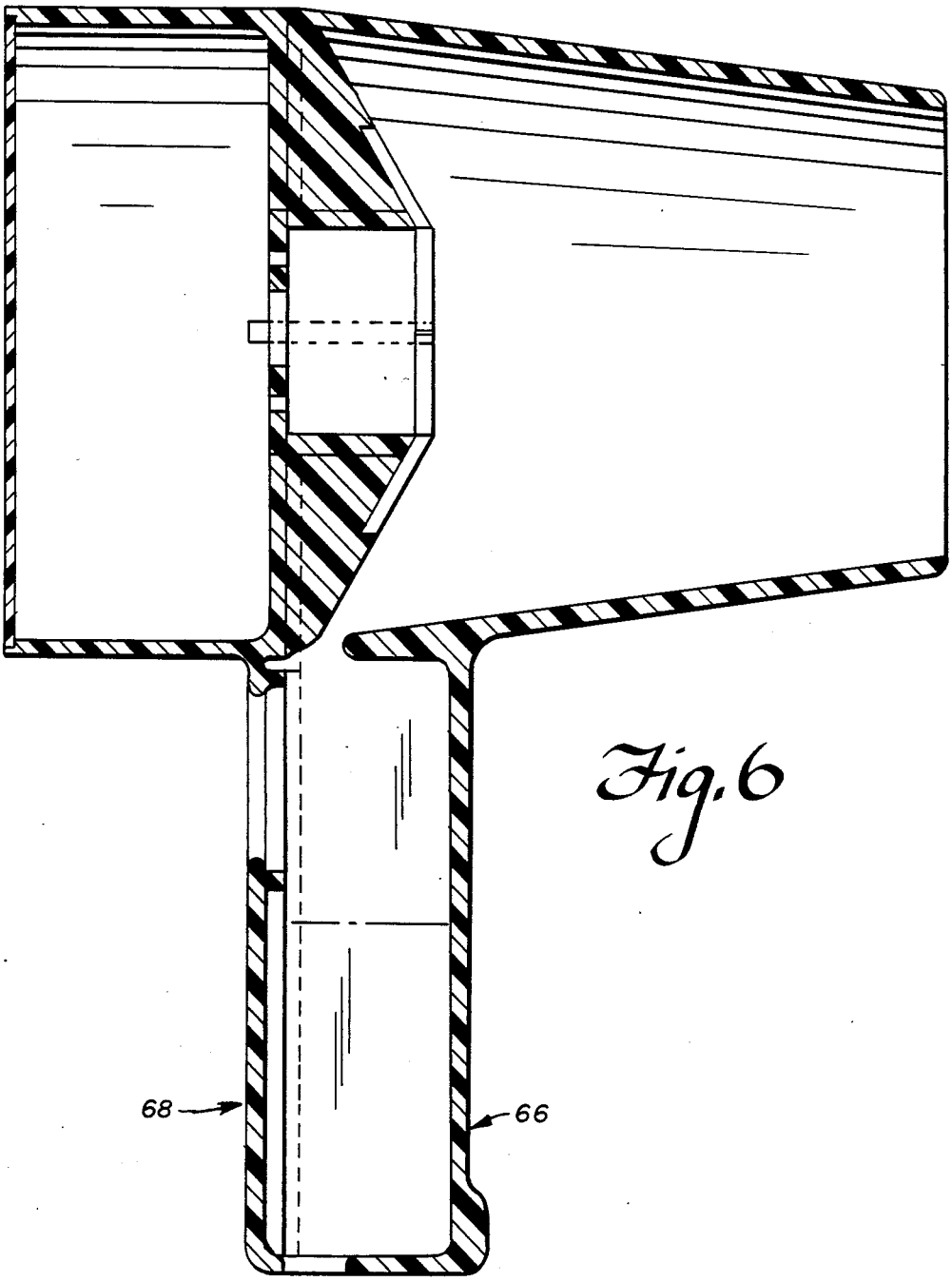
FIG. 6 is a longitudinal sectional view of the front and rear main portions of the housing thereof, assembled to one another, but with other elements of the dryer omitted.
Figure 7:
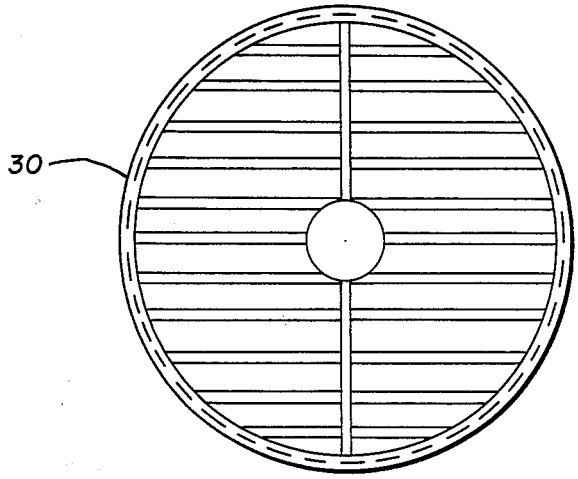
FIG. 7 is a front elevational view of the front screen/-front grille assembly of the dryer.
Figure 8:
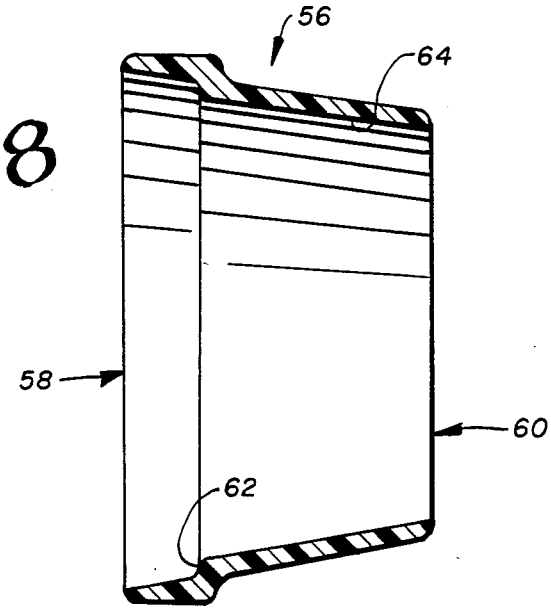
FIG. 8 is a schematic longitudinal sectional view of a concentrator for the barrel of the housing of the dryer.
Figure 9:
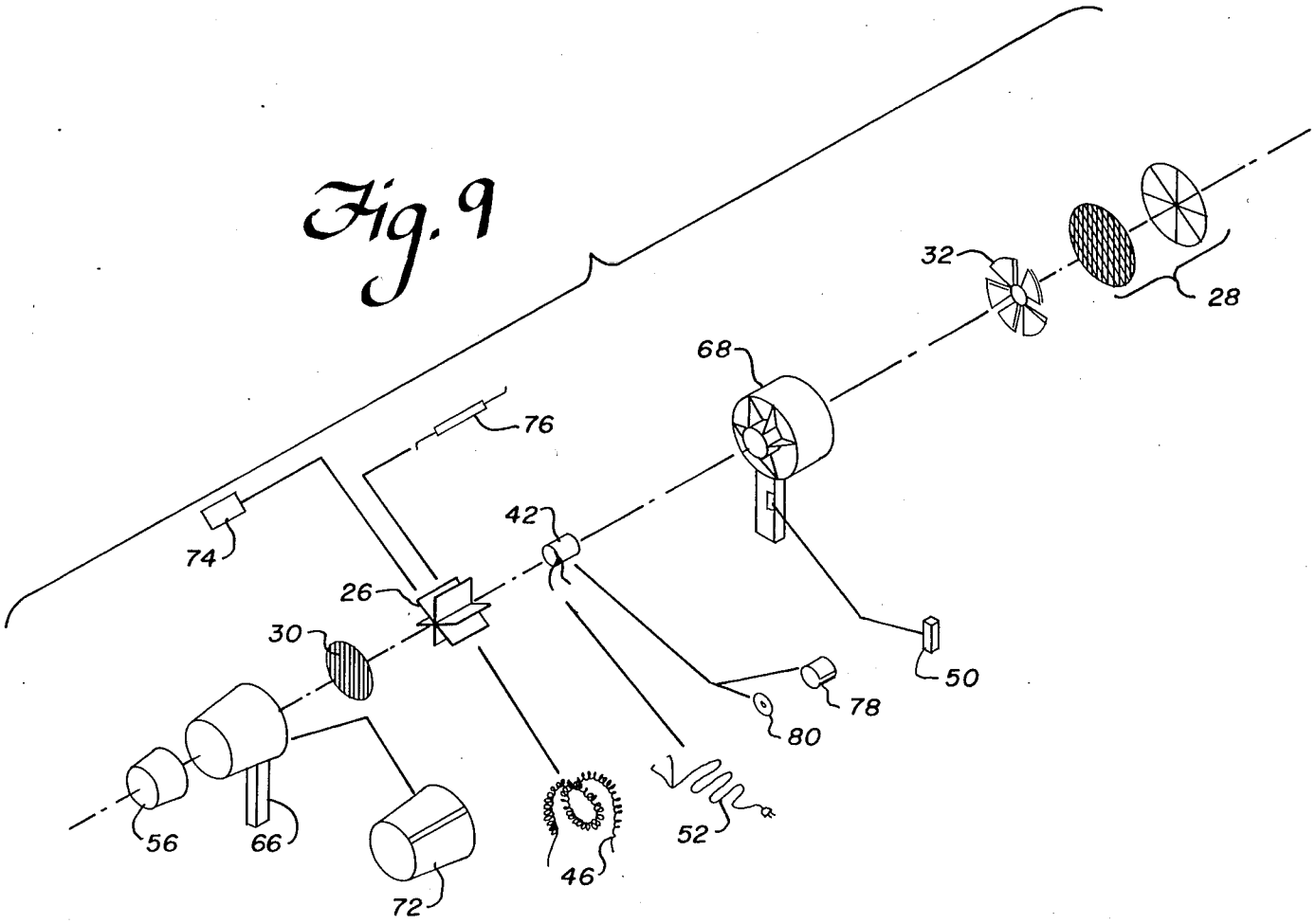
FIG. 9 is a small scale exploded perspective view of the dryer, including the optional concentrator.

The tube axial handheld dryer 10 of the present invention includes a housing 12 having a barrel 14 from which a handle 16 radially projects. The barrel has a larger-diameter inlet end portion 18, which is preferably generally circularly cylindrical, and a forwardly-tapering frusto-conically tapering outlet end portion 20, which are joined along a common circular juncture line 22 which is located approximately one-third forwards along the length of the housing from the inlet end. (In actual practice the housing 12 may be split into two longitudinal halves, as is a conventional practice, and conventional means provided for securing these halves together enclosing the working parts.)

Mounted on the longitudinal axis of the housing barrel 14 is a fan/motor/heating coil assembly 24, e.g. mounted in place with support from the inner peripheral wall of the barrel 14 using a mechanical spider 26.

Both the inlet end 18 and the outlet end 20 of the housing barrel 14 are preferably as open as possible over the full I.D. thereof, consistent with any applicable safety regulations; grilles, screening, parallel bars 28, 30 or the like conventionally provided, to the extent necessary, to prevent personal injury and/or damage to the device 10 as the dryer is in use.

The fan/motor/heating coil assembly 24 is shown comprising a fan 32 having 5–10 blades 33 radiating from a hub 34, the fan being coaxially located in the cylindrical inlet end portion 18 of the housing barrel 14, with its outer diameter being so large (approximately 98 percent that of the I.D. of the portion 18 of the housing barrel 14), that the tips 36 of the blades lie closely adjacent the inner peripheral wall 38 of the portion 18 of the housing barrel 14.

The hub 34 of the fan is mounted on the output shaft 40 of a coaxially-disposed D.C. motor 42 which has a circularly cylindrical housing 44, the outer diameter of which is approximately equal to that of the hub 34.

The heater coil 46 is shown provided as a series of toric units 48 of progressively smaller diameter, located coaxially surrounding the motor housing 44. (Both the motor 42, except for its output shaft 40, and the heating coils 48 are disposed within the tapering part 20 of the housing barrel 14.)

Actuation of the motor 42 and heater 46 is governed by a switch 50 interposed in the power cord 52 which serves the motor and the heater (by conventional wiring connections 54).

Referring to FIG. 3, a conventional concentrator attachment 56 may be provided to be removably frictionally telescopically externally mounted on the outlet end of the barrel for simultaneously lengthening the barrel and reducing its effective outlet diameter. The attachment 56 is geneaally frusto-conical with an open, larger diameter inlet end 58 and an open, smaller diameter outlet end 60. The rearwardly facing internal shoulder 62 provided in the concentrator 56 limits the telescopic insertion of the concentrator onto the barrel, whereupon the I.D. of the concentrator wall 64 smoothly continues the I.D. of the wall 66 of the outlet end portion.

For completing a description of the preferred embodiment, some quantitative dimensional chacteristics are now given by way of example.

The fan/motor/heating coil assembly 24 provides air flow rates up through 45 CFM; wattages up through 1800 watts; maximum air flow velocities in the range from 600 to 1000 feet/minute; fan impeller diameters ranging from 0.5 to 4 inches, and housings whose equivalent outlet diameters range from 2.5 to 4 inches. Judicious choosing among these parameter specifications results in a blow dryer design whose maximum on-axis noise level is maintained in the low 60 $db_A$ region.

A tube axial fan is one in which the inlet air ducts an outlet air ducts are in-line with the axis of rotation of the fan. The impeller, as driven by the motor and connecting shaft, draws air in through the inlet port and exhausts same through the outlet port. The impeller in this design is multibladed with between 5 and 10 blades. As the number of blades increases while the RPM are held constant, the basic frequency of the unit increases. Therefore, in order to keep the audio frequency as low as possible, it is desirable to use a fan with as few blades as necessary to deliver the correct flow rate. The fan hub diameter is selected to coincide with the diameter of the motor. The overall fan diameter is 98 percent of the housing diameter. Unlike the turbo dryer, the tube axial fan is principally a low static pressure fan. Static pressure is the amount of pressure that the fan must develop within the blow dryer in order to deliver the required air flow rate.

The placement of the heating element within the blow dryer is crucial to its overall performance as any geometric obstruction placed in the air stream increases the internal static pressure. And any increase in static pressure increases the noise power. Accordingly, the heating element is best placed in a planar doughnut or helix fashion forward of the fan. This is in contrast to the conventional designs which provide an elongated mica frame for supporting the heating element. This convention design characteristically channels the air stream into, generally, four quadrants. The preferred embodiment of the present invention, however, makes use of the minimal obstruction presented by a nominal depth support frame 26 for the heating element. This nominal depth support frame is positioned so that the air stream is presented edgewise to it. An alternate and equally acceptable method of installing the heating element would be to wrap it in an helix fashion along the longitudinal axis of the motor and to anchor it to mica or ceramic supports which are strategically placed on the inside circumference of the housing. These mica or ceramic inserts anchor the heating element as necessary to provide the required mechanical rigidity to prevent movement while presenting the least amount of air flow obstruction.

The shape of the housing barrel as shown is partially cylindrical and partially tapered cylindrical. Any number of barrel shapes or combinations thereof, such as wholly cylindrical, rectangular, elliptical, etc., would also accomplish the barrel function of confining and directing the air flow while presenting very low air flow restrictions; and these configurations and their derivations are included in this invention.

The fan is powered by a fractional HP motor whose geometry does not measurably impede the air flow through the housing. The diameter of the motor is selected so as to be the same diameter as the hub of the fan. The motor is powered by electrical current through a conventional electrical cord when the cord is plugged into a power source. Switches are provided in the handle to allow for adequate control of heat and air flow rates. Forward of the fan blade is a heater assembly. The heater assembly includes one or several heater coils supported by a suitable heater support frame. The wrapping of the heating element is in a helix fashion along the longitudinal axis of the motor. Also supported on the frame and electrically connected to the coils, but not shown, are a thermostat and fuse, which insure that the heater assembly does not overheat.

In designing a dryer embodying principles of the present invention, one typically selects a value for one variable, and then provides others in relation to the selected one to achieve the desired mode of operation. For instance, one may initially select the outlet opening of the outlet end of the barrel of the housing to have an I.D. of 2.875 inches. This outlet diameter will give approximately 6.5 square inches of coverage area. This is in striking contrast to the maximum 3.5 square inches of coverage area found on the typiaal currently marketed prior art dryers. Actually it makes very good sense to significantly expand the area of coverage; for the human head is much nearer the size of a soccer ball than it is to the size of a grapefruit. So covering an area essentially equivalent in size to the palm is much more effective than covering an area equivalent to the circle made by the first finger and thumb.

The second variable selected typically is the inlet diameter. In this example, it is set to 4.25 inches, to accommodate a 4 inch, 5-bladed fan. The third variable is the length of the housing, e.g. 5.75 inches from inlet to outlet (excluding the concentrator attachment). The distance from the downstream end of the heating coils to the outlet is approximately 2.0 inches.

In the preferred embodiment, the ratio of inlet to outlet diameter dimensions is nominally 1.48 to 1 (i.e. approximately 1.5–1), with the inlet dimension being restricted to a diameter of no less than 3.75 inches. The clearance from the fan blade tip extremities to the case wall does not exceed 0.125 inches. The fan is a tube axial fan the hub of which measures not less than 1.0 inch in diameter and is at least as large in diameter as the motor. The motor is of the DC type to provide a nominal speed of 6000 RPM at normal operating speed (plus or minus 1000 RPM). All case ribbing struts perpendicular to the air flow preferably have knife edges to maximize air flow and reduce to an absolute minimum back pressure, and surfaces that would produce turbulence, and therefore an increase in the overall noise level. The concentrators provided with most, if no all other dryers, have no practical use because the velocity of the air stream is already too high and the temperature too hot. With the present design, however, the concentrator may be effectively used to isolate areas for lifting, pulling hair outward from scalp or curling hair to a desired style without burning either the hair or the scalp. The ratio of inlet to outlet dimensions of the concentrator is nominally 1.15 to 1, with the inlet dimension being restricted to a diameter of no less than 2.875 inches.

Table I provides a comparison of certain features of the above-described exempliary embodiment of the tube axial fan handheld dryer of the present invention and eight typical turbo and professional dryers which were on the market in the United States as of October, 1983.

TABLE I

| BRAND & MODEL | TYPE | POWER watts (max) | COVERAGE $In^2$ | NOISE POWER $db_A$ (max*) | NOISE POWER $db_A$ (max**) | AIR FLOW VELOCITY ft/min |
|---|---|---|---|---|---|---|
| Exempliary Dryer of Present Invention | Special tube axial | 1300 | 6.5 | 60 | 62 | 1000 |

TABLE I-continued

| BRAND & MODEL | TYPE | POWER watts (max) | COVERAGE $In^2$ | NOISE POWER $db_A$ (max*) | NOISE POWER $db_A$ (max**) | AIR FLOW VELOCITY ft/min |
|---|---|---|---|---|---|---|
| Peter Hanz Silence HP | Professional blower wheel | 985 | 2.2 | 74 | 63 | 1716 |
| Pearlduck Inc. Model 1569 | Professional paddle wheel | 1265 | 3.5 | 77 | 71 | 1365 |
| Conair Pro 1500 | Professional paddle wheel | 1265 | 3.2 | 80 | 74 | 1493 |
| Helen of Troy Styling Machine 1200 | Professional paddle wheel | 880 | 1.9 | 73 | 71 | 1749 |
| Helen of Troy Silver Pro 1400 II | Professional paddle wheel | 1170 | 1.9 | 74 | 71 | 2091 |
| Helen of Troy Wonderwind Pro 1600 | Professional paddle wheel | 1182 | 3.4 | 72 | 74 | 1313 |
| Helen of Troy Vidal Sasson Professional 1250 | Turbo vane axial | 970 | 2.6 | 72 | 74 | 1749 |
| Montgomery Wards Model 1400 | Turbo vane axial | 1275 | 2.8 | 72 | 77 | 1719 |

*inline with air stream
**off-axis of air stream

For understanding the significance of Table I, it is noted that a change of 3 "A" weighted decibles corresponds to a halving or doubling of noise power, depending on direction. Accordingly, the dryer of the present invention is, on average, at least four times quieter than the typical prior art dryer. In addition, it is also significant that the on-axis decibel level is, as seen in the Noise Power column, lower than the off-axis decibel level. This means that the user will hear and experience a lower noise power level as he or she directs the unit at himself or herself than will the persons located in the surrounding environment.

In contrast to the turbo and professional models of the prior art, the dryer 10 of the present invention does not require constant motion over the surface area of the head to prevent a burning sensation. The changes to the prior art provided by the invention yield a blower that rapidly drys the hair and leaves it much more manageable; manageable in that it does not cause the small blistly tufts and the ruffled look that is one of the negative artifacts of the prior art dryers.

A user of the dryer of the present invention would notice the following distinguishing characteristics, relative to conventional handheld turbo and professional blow dryers of the prior art:

A. A much larger column of lower velocity air that penetrates to the base of the scalp without burning, maximizing the ideal concept of drying hair, based on being able to control the evaporation of moisture to a desired level compatible with the products and tools being used to design a particular hair style, i.e. some styles require that the hair not be dried 100% at the ends, but rather 90–95% at the base of the scalp.

B. Eliminates the fish hooks and tufts and ruffled split ends created by the concentrations of a high heat, high velocity air stream.

C. A substantial reduction in noise level which provides a dryer that can be used hour after hour by a professional stylist without causing stress either to himself or herself or the salon clientele, or by a regular consumer who does not wish to awaken the whole household while drying his or her hair.

D. The light weight high efficiency, without gyro effect, makes the tube axial dryer less fatiguing to use.

E. The concentrator can be used in a logical and practical way, since its outlet is tapered only enough to accent the concentration of air flow.

The front and rear sections of the housing are indicated by the numerals 66 and 68. One of the individual plates which assemble to form the spider 26 is indicated at 70. Thermal insulation for the front section of the housing is indicated at 72. A thermal switch and a thermal protector are indicated at 74, 76. Thermal insulation for the motor housing is shown provided as cup and end-disk elements at 78, 80.

It should now be apparent that the tube axial handheld blow dryer for hair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A tube axial handheld blow dryer for hair, comprising:

a housing including a tubular barrel having an inlet and an outlet, and a handle for permitting handholding of the housing, this handle being secured to the barrel intermediate said inlet and said outlet;

a fan-motor-heating coil assembly of coaxially disposed members, including a tube axial fan having at least five blades radiating from a hub to which said blades are attached; an axially rearwardly projecting output shaft from said motor; said hub of said axial fan being mounted on said shaft to be rotated by said motor; said motor having a generally cylindrical casing which is substantially equal in diameter to said hub; and said heating coil being disposed downstream of said fan but upstream of said outlet of said housing barrel;

mechanical spider means mounting said fan-motor-heating coil assembly coaxially in said housing barrel so as to provide a substantially unobstructed passageway axially of said housing barrel from said inlet to said outlet thereof;

said inlet being about 1.5 times the diameter of said outlet, and said inlet having a diameter of at least 3.75 inches;

said blades of said fan having tip portions located radially no more than about 0.125 inch from an inner peripheral wall of said tubular barrel;

said tube axial fan having a hub diameter of at least about 1.0 inch; and said motor being a D.C. motor having a normal operating speed of approximately 6000 RPM.

2. The tube axial handheld blow dryer for hair of claim 1, wherein:

said housing barrel has a substantially circularly cylindrical inlet end portion which contains said fan and into which said motor output shaft projects, and which extends throughout a rear approximately one-third of the length of said housing barrel; and a tapering outlet end portion which contains said motor, but for said output shaft, and said heating coil, and which extends throughout a front approximately two-thirds of the length of said housing barrel.

3. The tube axial handheld blow dryer for hair of claim 2, wherein:

said dryer, in use with, said heating coil powered by about 1300 watts and said fan providing an airflow velocity of about 1000 feet per minute, exhibits a noise power of about 60 $db_A$ on-axis of said outlet, and about 62 $db_A$ off-axis of said outlet.

4. The tube axial handheld blow dryer for hair of claim 2, further including:

a removable concentrator comprising a tapering tubular extension barrel for said outlet end portion of said housing barrel, said extension barrel having an inlet and an outlet with an inlet to outlet diameter ratio of about 1.15 to 1.0 and an effective inlet diameter of at least 2.875 inches.

5. The tube axial handheld blow dryer for hair of claim 4, wherein:

said concentrator has an effective length of about 1.5 inches, in addition to a larger-diameter inlet end portion which telescopingly fits over the outlet end portion of said housing barrel of said housing of said dryer.

6. The tube axial handheld blow dryer for hair of claim 1, wherein:

said heating coil radially surrounds said casing of said motor.

7. The tube axial handheld blow dryer for hair of claim 6, wherein:

said heating coil is provided in the form of at least one torus.

* * * * *